US007540561B2

(12) United States Patent
McWhorter et al.

(10) Patent No.: US 7,540,561 B2
(45) Date of Patent: Jun. 2, 2009

(54) BOATING SEAT UMBRELLA ASSEMBLY

(76) Inventors: Joe McWhorter, 2322 Hawk Meadows, Pearland, TX (US) 77581; Timothy Brent McWhorter, 11918 FM 2153, Sanger, TX (US) 76266

( * ) Notice: Subject to any disclaimer, the term of this patent is extended or adjusted under 35 U.S.C. 154(b) by 404 days.

(21) Appl. No.: 11/446,664

(22) Filed: Jun. 5, 2006

(65) Prior Publication Data

US 2006/0272688 A1 Dec. 7, 2006

Related U.S. Application Data

(60) Provisional application No. 60/687,151, filed on Jun. 3, 2005.

(51) Int. Cl.
*A47C 7/62* (2006.01)

(52) U.S. Cl. ..... 297/184.16; 135/16; 135/20.1; 248/286.1

(58) Field of Classification Search ..... 297/184.15, 297/184.16; 135/16, 20.1, 20.3, 15.1; 248/286.1, 248/279.1

See application file for complete search history.

(56) References Cited

U.S. PATENT DOCUMENTS

| | | | | |
|---|---|---|---|---|
| 6,032,917 | A * | 3/2000 | Shannon | 135/16 |
| 6,105,594 | A * | 8/2000 | Diaz | 135/16 X |
| 2003/0070698 | A1 * | 4/2003 | Wells | 135/20.1 |

* cited by examiner

*Primary Examiner*—Anthony D Barfield
(74) *Attorney, Agent, or Firm*—Conley Rose, P.C.

(57) ABSTRACT

An apparatus for providing shade to an individual is adjustable in three planes. In some embodiments, the shading apparatus include a primary shaft secured to a fixed base such as a pedestal seat. A height adjustable and telescoping secondary shaft is inserted concentrically into the primary shaft. A pivot joint assembly is secured to the secondary shaft, and a shading device is mounted to the pivot joint assembly. The pivot joint assembly allows for rotational, pivoting, and sliding adjustment in order to provide positional flexibility to the individual seeking shade.

21 Claims, 2 Drawing Sheets

BOATING SEAT UMBRELLA ASSEMBLY

CROSS-REFERENCE TO RELATED APPLICATIONS

The present application claims the benefit of, and incorporates by reference, provisional application Ser. No. 60/687,151, filed Jun. 3, 2005, and entitled "Boating Seat Umbrella Assembly."

STATEMENT REGARDING FEDERALLY SPONSORED RESEARCH OR DEVELOPMENT

Not applicable.

BACKGROUND

Shading apparatus that are intended to cover an area where chairs are located, especially as used on boats, are known in the art. Many boats have collapsible convertible tops that are permanently mounted to the boat and permit use only in a single location for protection against sun, wind, or rain. Many such tops tend to be bulky, are not portable, and cannot be configured in a variety of different locations or directions. Additionally, these tops can interfere with a fisherman sitting in a covered chair who is casting, requiring the removal of the top and the loss of shading protection that the top provides. As such, there remains a need for an adjustable shading apparatus for use with a boating seat.

SUMMARY OF THE PREFERRED EMBODIMENTS

The embodiments described herein are directed to an apparatus for shading an individual, and preferably, the apparatus is adjustable in three planes. In one embodiment, the boating seat umbrella assembly comprises a primary shaft secured to a standard pedestal seat assembly by a mounting bracket. A height adjustable and telescoping secondary shaft is inserted into the primary shaft and is secured in the desired vertical height position by an adjustment knob. The boating seat umbrella assembly further comprises a pivot joint assembly secured at the end of the secondary shaft, and an umbrella mounted to the pivot joint assembly. The entire boating seat umbrella assembly is secured relative to the pedestal seat base by an anti-rotation collar and anti-rotation device.

The umbrella assembly provides shade and rain protection to an individual sitting in, fishing from, or otherwise utilizing the seat. The boating seat umbrella assembly is designed for adjustment in three planes to fit the weather conditions, sun direction, and intended use of the seat. The boating seat umbrella assembly is further designed to incorporate the anti-rotation collar and anti-rotation device to prevent the rotation of the boating seat umbrella assembly upon the individual exiting the seat. The entire boating seat umbrella assembly disconnects from the pedestal seat assembly for storage and transport, and the umbrella itself disconnects from the boating seat umbrella assembly when required for transport, storage or replacement.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENTS

Figure 1:
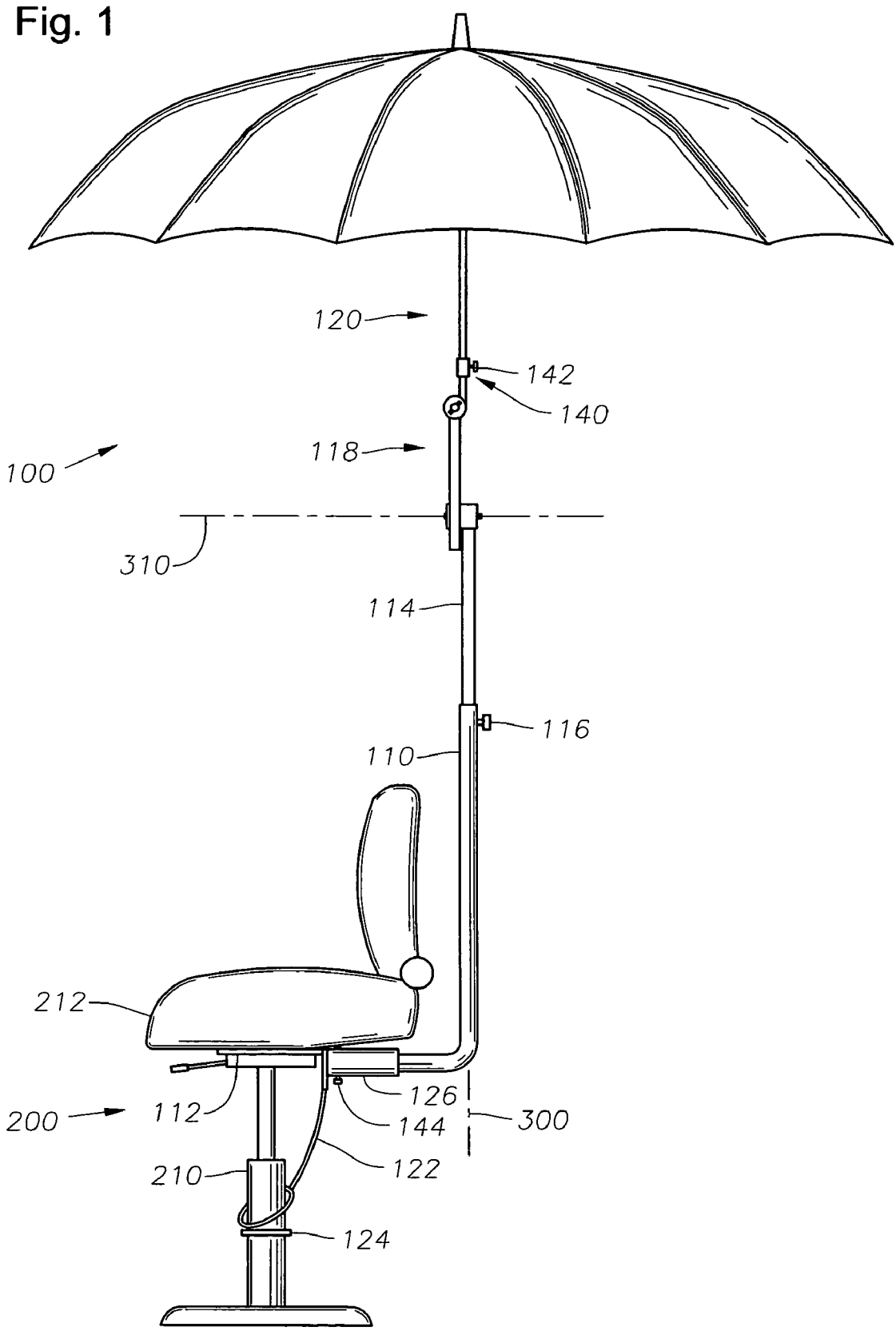
FIG. 1 is a side view of the boating seat umbrella assembly and pedestal seat assembly.

In the description that follows, like parts are marked throughout the specification and drawings with the same reference numerals, respectively. The drawing figures are not necessarily to scale. Certain features of the invention may be shown exaggerated in scale or in somewhat schematic form, and some details of conventional elements may not be shown in the interest of clarity and conciseness.

The present invention is susceptible to embodiments of different forms. There are shown in the drawings, and herein will be described in detail, certain embodiments of the present invention with the understanding that the present disclosure is to be considered an exemplification of the principles of the invention, and is not intended to limit the invention only to these embodiments illustrated and described herein. It is to be fully recognized that the different teachings of the embodiments discussed below may be employed separately or in any suitable combination to produce the desired results.

Referring to FIG. 1, one embodiment of boating seat umbrella assembly 100 includes primary shaft 110, mounting bracket 112, and secondary shaft 114. Pedestal seat assembly 200 comprises a fixed pedestal base 210 and seat 212. Mounting bracket 112 is designed to mount directly to pedestal seat assembly 200 between fixed pedestal base 210 and seat 212. Primary shaft 110 is secured to mounting bracket 112. Secondary shaft 114 is mounted concentrically within primary shaft 110.

Boating seat umbrella assembly 100 also comprises adjustment knob 116, which is located on primary shaft 110 and secures secondary shaft 114 in the desired vertical height position, and pivot joint assembly 118, which is attached to the end of secondary shaft 114 that is spaced apart from primary shaft 110. Pivot joint assembly 118 comprises lower pivot joint 130, lower pivot joint adjustment knob 132, upper pivot joint 136, and upper pivot joint adjustment knob 138. Pivot joint assembly 118 also comprises boom shaft 134, which connects lower pivot joint 130 and upper pivot joint 138. Shading device 120, which may comprise an umbrella with support shaft, is secured to boating seat assembly 100 at pivot joint assembly 118 through connection 140.

Boating seat umbrella assembly 100 further comprises anti-rotation device 122 and anti-rotation collar 124. Anti-rotation collar 124 encircles fixed pedestal base 210 and is secured such that anti-rotation collar 124 is constrained from rotating. Anti-rotation device 122 may be a fixed length member in tension, and is attached between anti-rotation collar 124 and mounting bracket 112. The fixed length of anti-rotation device 122 is such that it may not stretch or expand, and thereby prevents mounting bracket 112 from rotating with respect to fixed pedestal base 210 due to the force of tension between fixed pedestal base 210 and anti-rotation device 122 through anti-rotation collar 124. In addition to preventing the rotation of mounting bracket 112, anti-rotation device 122 and anti-rotation collar 124 also necessarily prevent the rotation of seat 212 and boating seat umbrella assembly 100.

Figure 3:
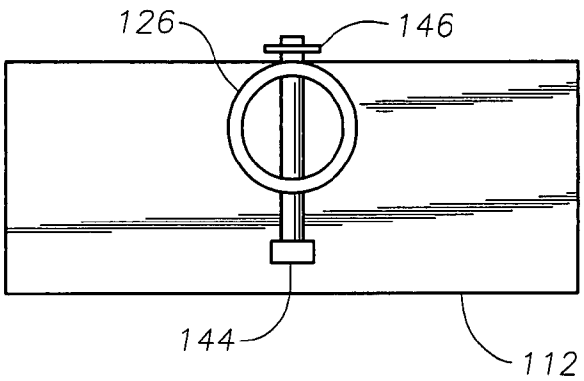
FIG. 3 is an enlarged rear view of the mounting bracket.
Figure 4:
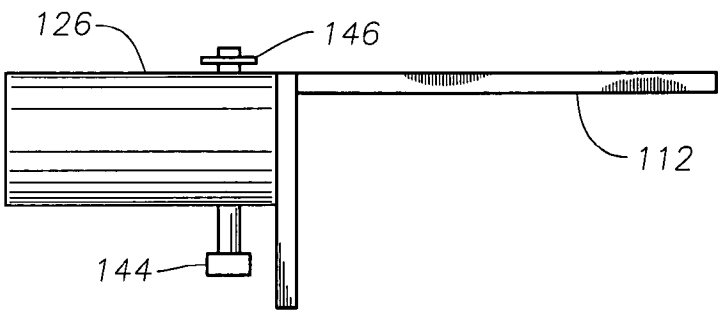
FIG. 4 is an enlarged side view of the mounting bracket.

Mounting bracket 112 incorporates the same standard mounting hole pattern as used on pedestal seat assembly 200 to secure seat 212 to fixed pedestal base 210. Mounting bracket 112 is secured between fixed pedestal base 210 and seat 212. Mounting bracket 112 also includes tubular member or sleeve 126, which is disposed on the rear of mounting bracket 112. Mounting bracket 112 remains attached to pedestal seat assembly 200 when the remaining components of boating system assembly 100 are removed for transport or storage. Primary shaft 110 is secured to mounting bracket 112 at tubular member 126 by inserting one end of primary shaft 110 into tubular member 126. Referring to FIGS. 3 and 4, latch pin 144 is radially inserted through tubular member 126 and primary shaft 110 and secures primary shaft 110 within tubular member 126. Latch pin clasp 146 constrains latch pin 144 in position. It is contemplated within the scope of this invention that alternative embodiments of boating seat umbrella assembly 100 may be mounted to fixed bases other than pedestal seat assembly 200. For example, umbrella assembly 100 may be mounted to any adaptable fixed surface on a boat, such as a boat rail or fishing rod holder.

Referring again to FIG. 1, secondary shaft 114 is mounted concentrically within primary shaft 110 and may telescope within primary shaft 110 so that secondary shaft 114 is vertically adjustable along longitudinal axis 300 of secondary shaft 114. The telescopic movement of secondary shaft 114 along longitudinal axis 300 allows for vertical height adjustment of pivot joint assembly 118 and shading device 120 based on the weather conditions, sun direction, and intended use of seat 212. For example, if a fisherman is using seat 212 and desires the shading protection of shading device 120, it may be desirable to extend secondary shaft 114 to its maximum height to facilitate the fisherman's ability to cast his line without interference with shading device 120.

Additionally, secondary shaft 114 is manually rotatable 360° around longitudinal axis 300. Once secondary shaft 114 reaches a desired height after it is manually extended from primary shaft 112, and the desired rotation of secondary shaft 114 has been achieved, secondary shaft 114 is constrained in position by adjustment knob 116. Adjustment knob 116 includes a threaded shaft that threadingly engages a threaded bore in primary shaft 112 and engages the outer surface of secondary shaft 114 to hold secondary shaft 114 in the desired position relative to primary shaft 112. Adjustment knob 116 is loosened, or disengaged from secondary shaft 114 to allow vertical height and rotational adjustment, and then tightened, or re-engaged with the outer surface of secondary shaft 114 to constrain secondary shaft 114 in the desired height and rotated position.

Figure 2:
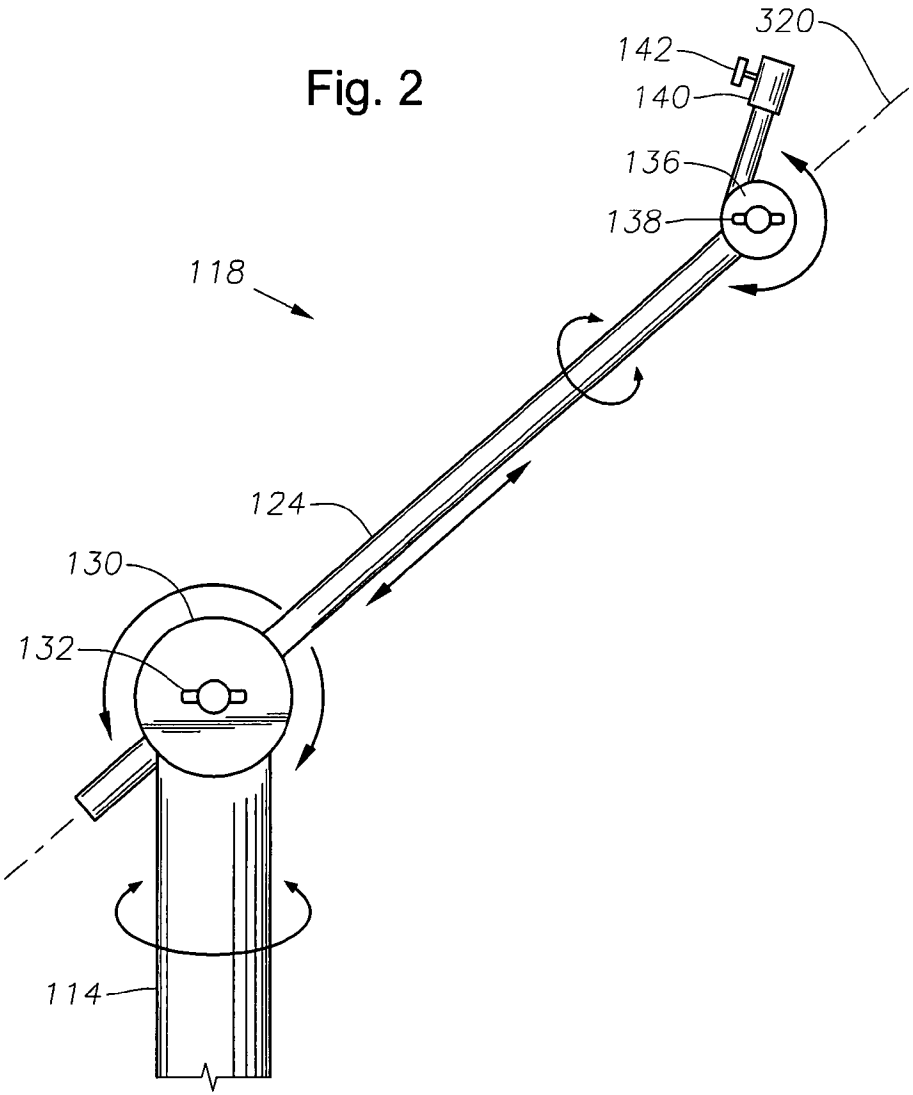
FIG. 2 is an enlarged side view of the pivot joint assembly.

Pivot joint assembly 118 is attached to one end of secondary shaft 114. Referring to FIG. 2, pivot joint assembly 118 comprises lower pivot joint 130, lower pivot joint adjustment knob 132, boom shaft 134, upper pivot joint 136, and upper pivot joint adjustment knob 138. One device suited especially well for use as pivot joint assembly 118 is a drum set cymbal boom stand. For example, models and manufacturers of cymbal boom stands suitable for use as pivot joint assembly 118 include: model 709 made by Dixon; 5600 Series made by Gibralter; and model B320 made by Mapex.

Pivot joint assembly 118, when attached to secondary shaft 114, shares the ability of secondary shaft 114 to rotate 360° around longitudinal axis 300. Lower pivot joint 130 is located at one end of pivot joint assembly 118 and is the attachment point of pivot joint assembly 118 to secondary shaft 114. Lower pivot joint 130 has the ability to pivot 270° with respect to radial axis 310 of secondary shaft 114. Boom shaft 134 is connected to lower pivot joint 130 and has a 270° pivot range in conjunction with lower pivot joint 130. Boom shaft 134 is also slidingly extendable along longitudinal axis 320 from its connection point with lower pivot joint 130 and is rotatable 360° around the longitudinal axis of boom shaft 134.

Lower pivot joint adjustment knob 132 threadingly engages lower pivot joint 130 and can be loosened, or disengaged to allow for the pivoting adjustment of lower pivot joint 130. Lower pivot joint adjustment knob 132 can also be tightened, or re-engaged to secure lower pivot joint 130 in a desired position. Additionally, lower pivot joint adjustment knob 132 threadingly engages boom shaft 134 and can be loosened, or disengaged to allow for the sliding extension and rotational adjustment of boom shaft 134. Conversely, lower pivot joint adjustment knob 132 can be tightened, or re-engaged to secure boom shaft 134 into a desired position or orientation.

Upper pivot joint 136 is attached at a second end of boom shaft 134. Upper pivot joint 136 has the ability to pivot 180° with respect to longitudinal axis 320 of boom shaft 134. Upper pivot joint adjustment knob 138 threadingly engages upper pivot joint 136 and can be loosened, or disengaged to allow for the pivoting adjustment of upper pivot joint 136. Upper pivot joint adjustment knob 138 can also be tightened, or re-engaged to secure upper pivot joint 136 in a desired position. Connection 140 is secured to upper pivot joint 136 and provides the connection point for shading device 120. Shading device 120 is inserted into connection 140 and secured by threaded connector 142.

Pivot joint assembly 118, through the pivoting ability of lower pivot joint 130 and upper pivot joint 136, as well as the ability of boom shaft 134 to rotate and slidingly extend, thereby allows for the adjustment of shading device 120 in three planes relative to seat 212. For example, if an individual is using seat 212 and is facing directly into the sun, it may be desirable to adjust pivot joint assembly 118, and correspondingly shading device 120, in the direction of the sun. Additionally, if a fisherman is using seat 212 and desires shade while maintaining the ability to cast a fishing line, it may be desirable to adjust pivot assembly 118, and correspondingly shading device 120, in a manner to allow the fisherman to cast a line without interference with shading device 120. As a result, the individual in seat 212 is shaded from the sun by shading device 120, while maintaining the ability to be active in seat 212 without interference from the components of boating seat umbrella assembly 100.

Further, pivot joint assembly 118 can be constrained in a desired position, thereby securing the position of shading device 120 in the orientation of choice. Shading device 120 may comprise a large golf-type umbrella, and may feature vents on the surface to minimize wind effects. Shading device 120 may be removed from connection 140 by disengaging threaded connector 142 while the remaining components of boating seat umbrella assembly 100 are kept intact while the boat is in motion.

While preferred embodiments of this invention have been shown and described, modifications thereof can be made by one skilled in the art without departing from the spirit or teaching herein. The embodiments described herein are exemplary only and are not limiting. Many variations and modifications of the system and apparatus are possible. Accordingly, the scope of protection is not limited to the embodiments described herein, but is only limited by the claims which follow, the scope of which shall include all equivalents of the subject matter of the claims.

What is claimed is:

1. An apparatus for providing shade, comprising:

a primary shaft having a first end and a second end, wherein the first end is secured to a fixed base;

a secondary shaft mounted to the second end of the primary shaft and adapted for telescopic adjustment and rotational adjustment with respect to the primary shaft;

a pivot joint assembly mounted to the secondary shaft and spaced apart from the primary shaft, wherein the pivot joint assembly is adapted for sliding adjustment, pivoting adjustment, and rotational adjustment with respect to the secondary shaft and comprises:

a lower pivot joint secured to the secondary shaft, wherein the lower pivot joint is operable for locking at a first pivot angle;

a boom shaft connected to the lower pivot joint; and an upper pivot joint secured to the boom shaft, such that the upper pivot joint is spaced apart from the lower pivot joint, wherein the upper pivot joint is operable for locking at a second pivot angle; and a shading device mounted to the pivot joint assembly.

2. The apparatus of claim 1, further comprising a mounting bracket and an anti-rotation device connected between the mounting bracket and the fixed base, and an anti-rotation collar adapted to secure the anti-rotation device to the fixed base.

3. The apparatus of claim 1, further comprising a mounting bracket between the first end of the primary shaft and the fixed base.

4. The apparatus of claim 1, wherein the secondary shaft is mounted concentrically with respect to the primary shaft.

5. The apparatus of claim 1, wherein the shading device comprises an umbrella with a support shaft, and wherein the support shaft is mounted to the pivot joint assembly.

6. The apparatus of claim 1, wherein the boom shaft is operable to provide the rotational adjustment and the sliding adjustment of the pivot joint assembly, and wherein the boom shaft is operable for locking in a desired position.

7. The apparatus of claim 6, wherein the first pivot angle has a range of zero degrees to 270 degrees with respect to a secondary shaft radial axis.

8. The apparatus of claim 6, wherein the second pivot angle has a range of zero degrees to 180 degrees with respect to a boom shaft longitudinal axis.

9. The apparatus of claim 6, wherein the boom shaft is adapted to rotate 360 degrees with respect to a boom shaft longitudinal axis.

10. The apparatus of claim 6, wherein the boom shaft is adapted for sliding adjustment along a boom shaft longitudinal axis.

11. The apparatus of claim 1, wherein the secondary shaft is adapted to rotate 360 degrees with respect to a secondary shaft longitudinal axis.

12. The apparatus of claim 1, wherein the shading device is removable from the pivot joint assembly.

13. The apparatus of claim 1, wherein the primary shaft is removable from the fixed base.

14. An apparatus for providing shade, comprising:

a seat supported by a fixed base;

a mounting bracket attached between the seat and the fixed base, the mounting bracket having a mounting sleeve extending from the mounting bracket;

a primary shaft having a first end and a second end, wherein the first end is secured to the mounting sleeve;

a secondary shaft attached to the primary shaft and adapted for telescopic adjustment and rotation adjustment with respect to the primary shaft;

a pivot joint assembly attached to the secondary shaft, wherein the pivot joint assembly is adapted for sliding adjustment, pivoting adjustment, and rotational adjustment with respect to the secondary shaft and comprises:

a lower pivot joint secured to the secondary shaft, wherein the lower pivot joint is operable for locking at a first pivot angle;

a boom shaft connected to the lower pivot joint; and an upper pivot joint secured to the boom shaft, such that the upper pivot joint is spaced apart from the lower pivot joint, wherein the upper pivot joint is operable for locking at a second pivot angle; and a shading device attached to the pivot joint assembly.

15. The apparatus of claim 14, further comprising an anti-rotation device connected between the mounting bracket and the fixed base, and an anti-rotation collar adapted to secure the anti-rotation device to the fixed base.

16. The apparatus of claim 14, wherein the boom shaft is operable to provide the rotational adjustment and the sliding adjustment of the pivot joint assembly, and wherein the boom shaft is operable for locking in a desired position.

17. The apparatus of claim 16, wherein the first pivot angle has a range of zero degrees to 270 degrees with respect to a secondary shaft radial axis.

18. The apparatus of claim 16, wherein the second pivot angle has a range of zero degrees to 180 degrees with respect to a boom shaft longitudinal axis.

19. The apparatus of claim 16, wherein the boom shaft is adapted to rotate 360 degrees with respect to a boom shaft longitudinal axis.

20. The apparatus of claim 16, wherein the boom shaft is adapted for sliding adjustment along a boom shaft longitudinal axis.

21. The apparatus of claim 14, wherein the secondary shaft is adapted to rotate 360 degrees with respect to a secondary shaft longitudinal axis.

* * * * *